United States Patent [19]

Martelli

[11] 3,955,603

[45] May 11, 1976

[54] LOOMS PROVIDED WITH MEANS FOR MAKING MOVEMENT THEREOF UNIFORM

[75] Inventor: Francois Martelli, Zillisheim, France

[73] Assignee: Societe Alsacienne de Constructions Mecaniques de Mulhouse, Mulhouse Cedex, France

[22] Filed: July 30, 1974

[21] Appl. No.: 493,666

[30] Foreign Application Priority Data

Aug. 23, 1973 France ..... 73.30541

[52] U.S. Cl. ..... 139/446; 139/190; 74/603; 139/449

[51] Int. Cl.[2] ..... D03D 47/18; D03D 49/60

[58] Field of Search ..... 139/127 R, 122 R, 123, 139/188 R, 190, 191, 1 R, 1 E; 74/603

[56] References Cited

UNITED STATES PATENTS

| | | | |
|---|---|---|---|
| 1,866,049 | 7/1932 | Marsh | 74/603 X |
| 2,162,312 | 6/1939 | Kronoff | 139/188 R |
| 3,159,186 | 12/1964 | Juillard | 139/127 R |
| 3,441,058 | 4/1969 | Bassing et al. | 139/1 R |
| 3,610,294 | 10/1971 | Maassen et al. | 139/123 |
| 3,717,182 | 2/1973 | Sparling | 139/188 |

FOREIGN PATENTS OR APPLICATIONS

| | | | |
|---|---|---|---|
| 942,380 | 5/1956 | Germany | 139/190 |
| 199,017 | 5/1971 | U.S.S.R. | 139/123 |
| 1,442,261 | 5/1966 | France | 139/190 |
| 1,535,660 | 7/1969 | Germany | 139/122 |
| 1,057,527 | 10/1953 | France | 74/603 |

*Primary Examiner*—James Kee Chi
*Attorney, Agent, or Firm*—Cantor & Kraft

[57] ABSTRACT

A textile machine incorporates a crank and a connecting rod which carries a mass of such value and so positioned that the moment of inertia of the connecting rod about the axis of the crank pin introduces inertial variations which are opposed to and of absolute values at least equal to the inertial variations due to the combined sley and weft inserter mechanisms as well as their controls. The invention is especially applicable to the regularization of the running of looms with stiff weft inserters.

9 Claims, 7 Drawing Figures

LOOMS PROVIDED WITH MEANS FOR MAKING MOVEMENT THEREOF UNIFORM

BACKGROUND OF THE INVENTION

This invention relates generally to all looms allowing considerable irregularities in motion and in which the inertial of the kinematics, led back to a constant speed component such as the driving shaft, has a perceptibly sinusoidal behavior.

The invention relates more especially to looms with stiff weft inserters which have imparted thereto a to-and-fro movement, and in which looms the weft is introduced and drawn into the shed by long needles perceptibly stiff over their whole lengths, as well as to ribbon looms in which the insertion is taken care of by short needles fixed on one end of a flexible drive ribbon.

In the course of one cycle in operation of shuttleless looms of the type in question, the kinematics introduce, at the level of the crankshaft controlling the sley, very large variations in speeds due essentially to the large variations in the inertia, led back to the motor or to the crank, of the control mechanisms of the sley and of weft insertion. The speed variations are always accompanied by very harmful large vibrations, as much in the weaving range as the level of the supplementary mechanical influences which they develop. The fitting on of a flywheel of sufficient inertial would raise the problem of the braking of a large mass in motion.

OBJECT AND SUMMARY OF THE INVENTION

An object of the present invention is to obviate or mitigate the disadvantage.

According to the present invention, there is provided a loom in which an oscillatory sley has imparted thereto a to-and-fro movement from a driving shaft, the loom including a crank connected to the driving shaft by a mechanically-operated linkage and a connecting rod having a crank-end articulated on said crank while a crosshead of said connecting rod is compelled to describe a perceptibly rectilinear path, with said connecting rod carrying a mass of such value and so located in itself that the moment of inertia of said connecting rod introduces inertial variations led back to said driving shaft, which variations are opposed to and of absolute values at most equal to the inertial variations due to the full sley motions as well as the controls of the latter, which latter variations are likewise led back to said driving shaft.

As the equivalent inertia of the kinematics of the looms first cited herein has a sinusoidal behavior, the regularization is obtained thanks to the 90° difference in phase of the function equivalent moment of inertia of the connecting rods with respect to the function of the initial kinematics.

The setting of the connection rods, on object of the invention, enables a regularization of the movement or a reduction in the speed variations during one cycle of the rotating components, such as the motor and crankshaft. It allows, in certain conditions, a partial but significant balancing of the horizontal vibrations produced by the sley and its operation.

The means proposed by the invention, for a regularization comparable to that obtained by a flywheel keyed onto the crankshaft or other rotating component, offers the advantage of bringing into play a relatively small mass (only a few kilograms) and of creating a variation in its kinematic energy constantly opposed to that connected with the other moving elements. There is thus obtained braking of the entire mechanism when the latter would be inclined to race and an acceleration when, on the contrary, it would be inclined to slow down, so that the combined movement is ultimately regularized.

When the loom already includes a connecting rod and crank system for the operation of the sley or the inserters, the characteristics, which form the subject of the present invention, may be given to the connecting rod or connecting rods of these systems. Otherwise, there is introduced into the existing mechanism a special connecting rod and crank system according to the invention, of which the crank is appropriately angularly keyed with respect to the existing mechanical components for controlling the alternating movements of the sley and of the inserters.

An embodiment of the invention will now be described, by way of example, with reference to the accompanying drawings which show a device for controlling the motions of a loom with rigid or stiff weft-inserting needles.

BRIEF DISCRIPTION OF THE DRAWINGS

DETAILED DESCRIPTION OF THE INVENTION

Figure 1:
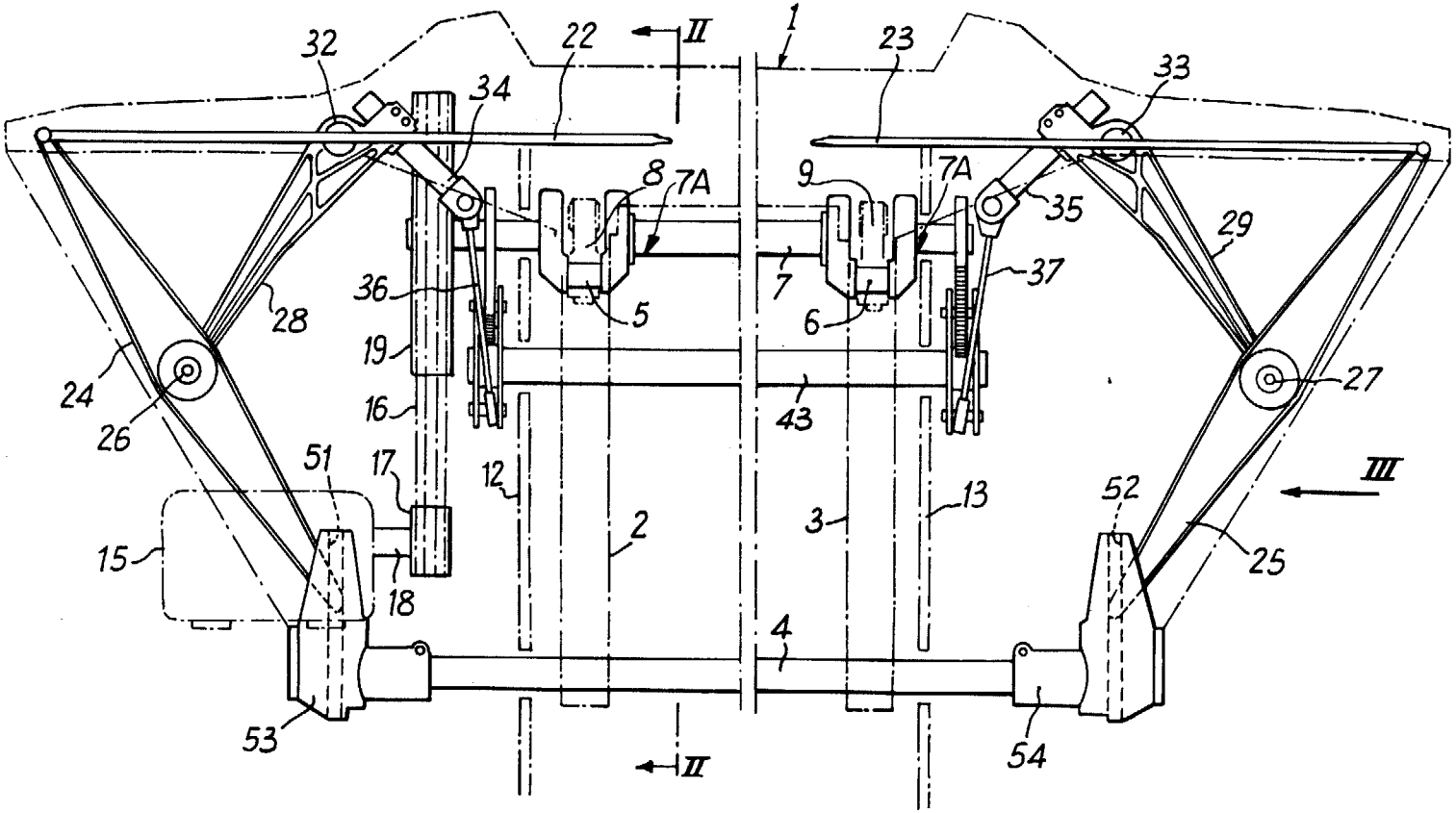
FIG. 1 is a diagrammatic front view of the sley and the weft-inserting needles, as well as their controlling mechanisms.
Figure 2:
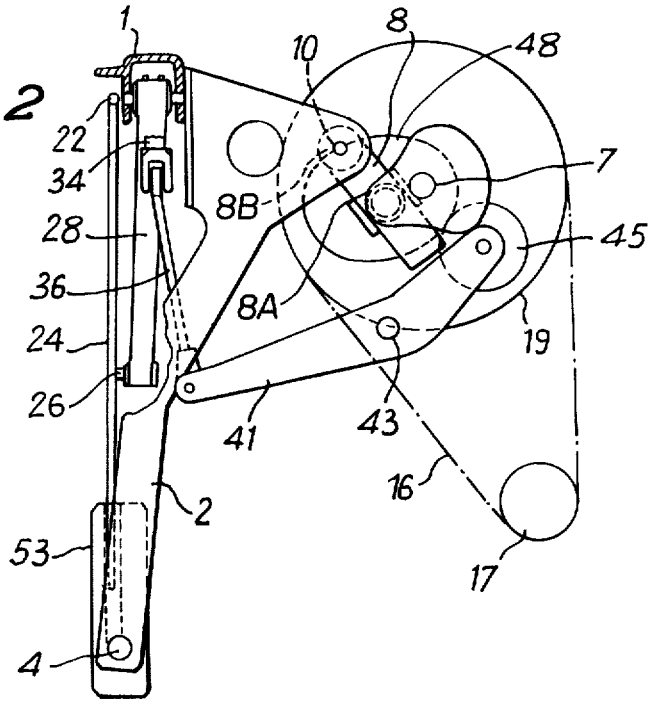
FIG. 2 is a vertical section taken along the line II—II in FIG. 1.
Figure 3:
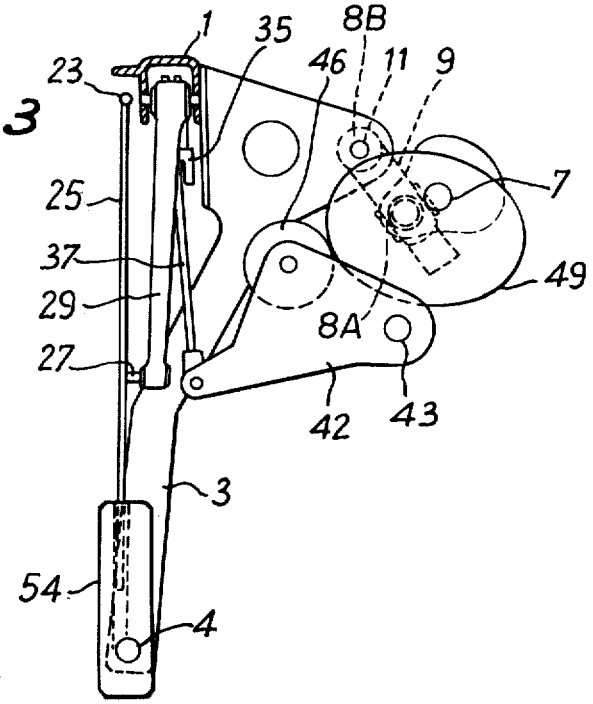
FIG. 3 is a side view seen in the direction of the arrow III in FIG. 1.

Among the few essential parts of a shuttleless loom, shown in FIGS. 1 to 3, there are:

a sley 1 fixed on the upper ends of two swords 2,3 the lower ends of which are fixed on a lower shaft 4 of the loom. The two swords 2, 3 are connected to two journals 5, 6 of crank means 7A of a crankshaft 7 by crank ends 8A, of two connecting rods 8, 9 and by crossheads 8B to two shafts 10, 11 (FIGS. 2 and 3) respectively. The lower shaft 4 and the crankshaft 7 are journalled in two cheek plates 12, 13 which constitute part of the machine frame. The crankshaft 7 which constitutes a driving shaft is rotated from an electric motor 15 through the intermediary of belts 16 which are entrained about a pulley 17 fixed on a shaft 18 of the motor 15 and a pulley 19 fixed on the crankshaft 7.

Two stiff weft-inserting needles 22, 23 are articulated, through their external ends, on the upper ends of two double-armed levers 24, 25, the arms of which are of equal length and which pivot, through shafts 26, 27, about the ends of two arms 28, 29 which themselves pivot on shafts 32, 33 carried by the sley and which are rigidly locked on two other arms 34, 35, respectively, connected, by two tierods 36, 37, respectively, to two other two-armed levers 41, 42 carried by a transverse shaft 43 which is also journalled in the cheek plates 12, 13 of the frame.

The shaft 43 is in the form of a torsion bar which continually presses two rollers 45, 46 in opposition on two cams 48, 49 rigidly locked with the crankshaft 7. Finally, the lower ends of the two double levers 24, 25 slide in two radial guides or grooves 51, 52, respectively, formed in two supports 53, 54 fixed on the two ends of the lower shaft 4.

The structure which has just been succinctly described is one of the numerous conventional constructions of shuttleless looms. The electric motor 15 drives, through the intermediary of the transmission by belts 16, the crankshaft 7 which, in turn, imparts its to-and-fro movement through the intermediary of the connecting rods 8 and 9. At the same time, the cams 48, 49 fixed on the crankshaft impart to the two needles a corresponding cyclic movement of moving towards one another and moving apart which enables them to introduce into the shed, weft from external bobbins.

Figure 4:
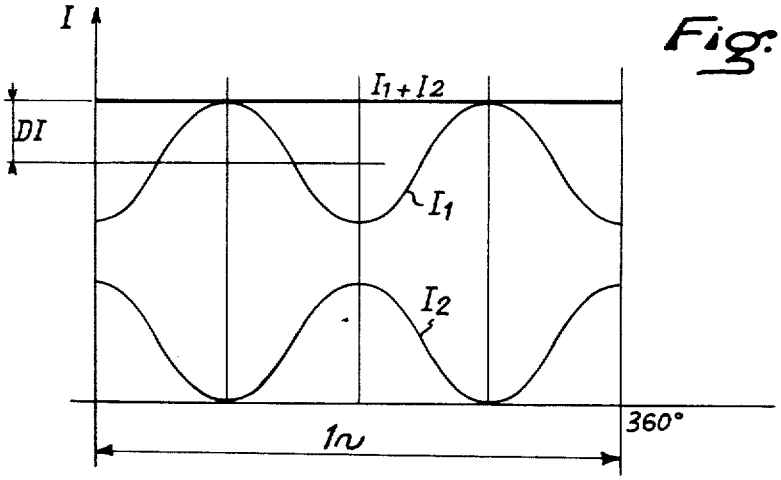
FIG. 4 is a graph providing qualitatively the relative values of the inertias at work in the mechanism of FIGS. 1 to 3.

On the graph of FIG. 4, there is shown, for one period or phase, i.e. for one full revolution of the crankshaft 7, in terms of the angular position of said crankshaft, a curve $I_1$ of variations in the inertia reduced at the crankshaft of the control mechanisms together of the sley and of the weft-inserting needles, such as have just been described. The course of this curve is perceptibly sinusoidal.

If there is now considered the variation in the inertia also reduced at the crankshaft, of the two connecting rods 8 and 9, it is established that the course of a corresponding representative curve $I_2$ is likewise perceptibly sinusoidal and in phase opposition with the curve $I_1$.

If, consequently, it is ensured that the variation in inertia of the connecting rods, in absolute terms, is equal to the variation in inertia of the control mechanisms of the sley and weft-inserting needles together, there is obtained a curve representative of the total inertial constituted perceptibly by a horizontal straight line indicated by $(I_1 + I_2)$, i.e. to sum up the entire machinery assembly with no longer present any appreciable variation in total inertia.

Figure 5:
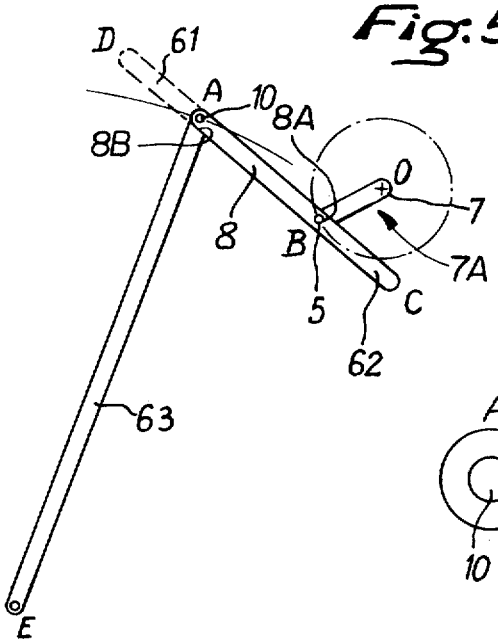
FIG. 5 illustrates the principle of equalization according to the invention.

In order to achieve an increase in the inertia of each connecting rod such as 8 for example, indicated at AB in FIG. 5, it is possible to proceed in one of the three following ways:

a. add an inertia block 61 shown in broken lines from A to D in FIG. 5, as an axial extension of the connecting rod 8 in the direction of the sley. The distribution of the equivalent mass of the connecting rod is then always positive at the point A and it may become negative at the point B.

b. introduce an imbalance between the two points A and B of articulation of the connecting rod. In this case, the equivalent masses at A and B are always positive.

c. add an inertia block 62, as indicated in full lines at BC in the axial extension of the connecting rod AB beyond the point B. In this case, the equivalent mass at the point B increases, whereas the equivalent mass at the point A decreases and may even become negative.

In this third proposition, it is established that, in addition to the introduction by specially-shaped connecting rods of a variable inertial making up for that of the control kinematics of the sley and of the weft inserters, two other regulating effects are created, less important than the first but nevertheless not negligible, namely:

by the presence of the equivalent mass of the connecting rod negative at the point A (FIG. 5), an influence on the regularization comparable to that produced by a considerable reduction in the weight of the sley and the parts which are rigidly locked therewith, schematically indicated as a whole by the part 63 on FIG. 5. This influence is always favorable to the motion, and, moreover, subject to balancing at the level of the crankshaft of the equivalent mass introduced at the point B, it enables correct balancing of the horizontal forces of inertia introduced by the sley.

the creation of a "fly-wheel" effect favorable to the regulation by the contribution of a sufficiently large mass at the point B equivalent to the connecting rod (just as the contingent inertia blocks for balancing of the crankshaft).

The modification of the shape of the connecting rods, as indicated in the third proposition above, therefore produces better results of regularization, even in the case where the motivations inherent in the braking efficiency would lead to neutralization of the fly-wheel effect by weight reductions at the level of the parts with constant inertia.

However, if it were not possible to extend the connecting rod beyond the point B, that is to say towards the point C, for reasons of space restriction or else if the mass at B were to become too large to permit proper braking (that is to say if it were no longer possible to neutralize same by a reduction in the constant inertia, there would be an inducement to adopt the second proposition consisting in introducing an imbalance the two articulations A and B of the connecting rod.

As far as the first proposition indicated above is concerned, it does not lend itself well to any application, as the regularization introduced by the increase in the inertia of the connecting rod turns out to be jeopardized by the large increase in the inertia of the sley resulting from the positive and large equivalent mass introduced at the point A (increase in the vibrations introduced by the sley).

The increase DI (FIG. 4) in the average inertia which has to be absorbed in braking, while remaining low relative to that which would be introduced by making the fly wheel heavy, with even regulation, may be neutralized by reduction of the constant inertia of the kinematics without notably interfering with the regulation effects achieved.

Figure 6:
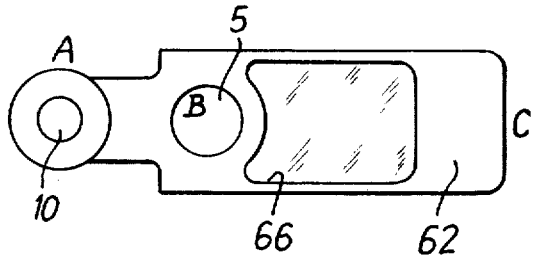
FIG. 6 is a front view of one embodiment of a connecting rod improved according to the principle of FIG. 5.

There is shown on FIG. 6, by way of example, a possible shape of connecting rod settled in accordance with the third proposition, with the material of the extension 62 being concentrated at the end of the extension of the connecting rod which is hollowed out over the remainder of its length as indicated at 66, while presenting a reinforcing median web.

In all of the foregoing, it has been supposed that the existing kinematics of the loom called for systems with control by a connecting rod and crank. If the existing kinematics did not call for such, the invention could, however, be applied and the same advantages perceptibly obtained by introducing, on the main shaft of the loom receiving the movement of the motor, a connecting rod and crank device of the kind of those described hereinbefore and in which the foot of the connecting rod $A_1$ in order to describe a linear trajectory should be guided, for example, in a groove or slideway 71 integral with the frame, as shown on FIG. 7, the connecting rod, that is to say the part $A_1$ to $B_1$, being always designated 8 and its extension $B_1$ to $C_1$ by forming an inertial block being designated 62.

In FIG. 5, the crank means 7A is pivoted at B to the connecting rod 8, with the pivot being at the crank end 8A of the rod while the cross-head 8B of the rod is connected to the shaft 10. The cross-head of the connecting rod is compelled, as previously stated, to describe a perceptibly rectilinear path, and this path is the path of travel of the outer end A of the level 63 which is pivoted at its inner end at E.

Figure 7:
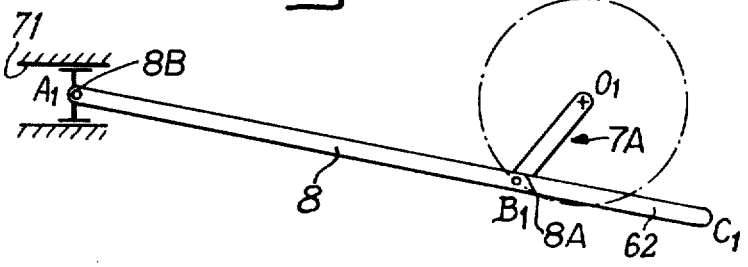
FIG. 7 shows a connecting rod crank system according to the invention intended to be mounted in a machine the existing mechanism of which does not include a connecting rod crank for controlling the principal parts.

In FIG. 7, the crank means 7A is pivoted at the crank end 8A of the connecting rod 8 at $B_1$. The cross-head 8B is pivoted to a shoe which is mounted for sliding movement in a rectilinear guide-way 71 whereby the cross-head is compelled to describe a rectilinear path.

The present invention procures advantages in the mechanical, electrical, and textile fields.

In the textile field, it provides a regulation of movement which leads to reduction in weft stop motions and warp stop motions by reducing pulls imposed on the thread; it restricts bad interchanges in the insertion of the weft, as well as the risk of a bad choice of frames in control by dobby or of healds in Jacquard control. Indeed, all the movements of the head-motion selection devices, both of dobby and of Jacquard, are based on a law of uniform motion of the crankshaft, so that it is desirable to approximate as closely as possible to the theoretical laws in order to avoid bad selections.

In the mechanical field, it provides a large reduction in the vibrations introduced by the inertial forces of the sley, a reduction in the noise as direct consequence of the lessening of the vibrations, a reduction in stress and strain on account of the maximal accelerations and a large reduction of the mechanical pulls of the transmission pulleys and of the motor by a large reduction in the variation of the resistant couple.

In the electrical field, it ensures: a reduction in the current demands of the motor which have at times to speed up the masses in movement and at other times to slow them down; a reduction in the momentray overloadings and in the temperature rises with the possibility of using a less powerful motor; and an increase in the cosine "phi" product, which leads to a reduction in the strength of current consumed and a lessening in the consumption of current.

Moreover, it has been seen hereinbefore that the invention procures regulation effects much greater than would be obtained with an equal added mass, by increasing the moment of inertia of the fly-wheel, and there is, in addition, the possibility of acting in different ways upon the regulation and braking of a loom, namely:

1. Obtain a regulation of maximum movement, give up introducing an increase in the inertial to be overcome at the moment of braking with a brake of the sufficiently powerful motor, by using the third proposition set out hereinbefore.

2. Obtain a sufficiently large regulation of movement, without, however, having perceptibly to modify the braking conditions which are at the approved limit. In this case, use will be made of the second or third proposition pointed out hereinbefore and the increase in inertia to be overcome at braking will be compensated by reduction in weight of the part of the kinematics with constant inertia (crankshaft, transmission pulleys, etc.).

3. Maintain without modification the irregularities in movement (if, of course, they would be acceptable) and reduce considerably the inertia to be overcome at the instant of braking. The invention is then brought into play as indicated in paragraph (2) above with, however, much greater reductions of constant inertia.

In one practical embodiment, there are obtained by putting the invention into practice and without modification of the initial braking conditions, a reduction of the order of 35% in the irregularities in movement, as well as a lessening by about 20% of the horizontal vibrations introduced by the forces of inertia of the sley. This has enabled the nominal speed to be increased by about 25%.

It has been possible to bring about the reduction in the constant inertia by straightforward action on the driven pulley of the crankshaft.

Of course, the invention is not limited to the embodiments described and illustrated, and it is capable of many modifications within the scope of those skilled in the art, in accordance with the applications contemplated and without thereby departing from the scope of the invention.

Thus, for example, in a loom in which neither the existing kinematics of control of the sley nor the kinematics of control of the weft would call for a connecting rod and crank system, the special connecting rod for regulation of motion would form part of kinematics added to this existing kinematics.

Also in the case of a loom in which the existing kinematics of control of the sley and-or of control of the weft inserters would already call for a connecting rod and crank system, but which, for structural reasons, would call for connecting rods with geometrical features, for example for fastening by wedges, for amplitude of movement, dimensional, etc., which would not be propitious to being adapted for regularization of the movement in accordance with the concept of the invention, the aforesaid specially-designed connecting rod would form part of kinematics added to the existing kinematics of the loom.

I claim:

1. A loom comprising an oscillatory sley, a driving shaft, activating means imparting to said sley from said driving shaft, a to-and-fro movement, a crank rotatable by said driving shaft, a connecting rod having a crank end and a cross-head, said crank end being articulated to said crank, and means compelling said cross-head of said connecting rod to describe a perceptibly rectilinear path, said connecting rod directly carrying an additional mass whereby the moment of inertia of said connecting rod introduces inertial variations led back to said driving shaft which are opposed to and of absolute values at most equal to the inertial variations due to the full sley motions and the motions of said activating means likewise led back to said driving shaft.

2. The loom as set forth in claim 1, including weft inserters, and activating means imparting to said weft inserters from said driving shaft a to-and-fro movement, whereby the moment of inertia of said connecting rod introduces inertial variations led back to said driving shaft which are opposed to and of absolute values at most equal to the inertial variations due to the combined sley and inserter motions and the motions of all said activating means likewise led back to said driving shaft.

3. The loom as set forth in claim 2, in which said weft inserters are stiff weft inserters.

4. The loom as set forth in claim 2, in which said weft inserters are ribbon weft inserters.

5. The loom as set forth in claim 1, in which said mass carried by said connecting rod is situated in an extension of the latter from said crosshead end thereof beyond the head of said crank.

6. The loom as set forth in claim 1, in which said mass carried by said connecting rod is situated between the two ends of said connecting rod.

7. The loom as set forth in claim 2, in which said connecting rod forms part of the existing kinematics for control of at least one component of the group comprising said sley and said weft inserters.

8. The loom as set forth in claim 2, in which said connecting rod forms part of kinematics added to the existing kinematics of the loom in which the control for neither component of the group comprising said sley and said weft inserters includes a connecting rod and crank system.

9. The loom according to claim 2, in which said connecting rod forms part of kinematics added to the existing kinematics of the loom in which the control for at least one component of the group comprising said sley and said weft inserters already includes a connecting rod and crank system.

* * * * *